United States Patent [19]

Black

[11] 4,151,456

[45] Apr. 24, 1979

[54] VOLTAGE REGULATOR FOR BATTERY POWER SOURCE

[75] Inventor: James M. Black, Lancaster, Calif.

[73] Assignee: The United States of America as represented by the Administrator of the National Aeronautics and Space Administration, Washington, D.C.

[21] Appl. No.: 885,049

[22] Filed: Mar. 9, 1978

[51] Int. Cl.[2] ..... G05F 1/56

[52] U.S. Cl. ..... 323/22 T

[58] Field of Search ..... 307/296 R, 297, 304; 323/16, 39, 19, 22 R, 22 T

[56] References Cited

U.S. PATENT DOCUMENTS 3,813,595 5/1974 Sheng ..... 323/22 R 3,899,693 8/1975 Gaudreault ..... 307/297

4,005,353 1/1977 Yokoyama ..... 323/22 R

*Primary Examiner*—A. D. Pellinen

*Attorney, Agent, or Firm*—Monte F. Mott; John R. Manning; Paul F. McCaul

[57] ABSTRACT

A voltage regulator for a battery power source capable of maintaining a predetermined voltage until the battery voltage decays to very nearly the predetermined voltage uses a bipolar transistor in series with the battery as the control element in series with a zener diode and a resistor. A field effect transistor between the base of the bipolar transistor and a junction between the zener diode and resistor regulates base current of the bipolar transistor, thereby to regulate the conductivity of the bipolar transistor for control of the output voltage.

7 Claims, 3 Drawing Figures

VOLTAGE REGULATOR FOR BATTERY POWER SOURCE

ORIGIN OF INVENTION

The invention described herein was made by an employee of the United States Government and may be manufactured and used by and for the Government for governmental purposes without the payment of any royalties thereon or therefore.

BACKGROUND OF THE INVENTION

This invention relates to a voltage regulator, and more particularly to a circuit for regulating battery voltage source.

In many applications, equipment with battery operated power regulation is required. A typical application is for airborne television using a battery operated miniature camera. The problem is to provide a circuit that regulates voltage with maximum utilization of available battery power, i.e., with maximum efficiency.

The prior art has not fully utilized available battery power because the difference between the regulated output voltage and the battery voltage had to be maintained at one volt, or more. That is wasteful at the end portion of the discharge cycle because the final one volt of battery voltage above the regulated voltage can not be utilized.

The graph of FIG. 1 is useful in understanding this problem. A voltage regulator maintains a constant voltage output at some predetermined level substantially below the initial (fresh charge) voltage. When the battery voltage has decayed to a level within a difference $\Delta V$ that must by maintained between the regulated output voltage and the battery voltage, the battery is no longer useable.

The useful life of a battery could be extended significantly from time A to time B in the graph of FIG. 1 if its regulated output voltage could be maintained with a difference $\Delta V$ that is substantially zero. The importance in thus extending the life of a battery can be appreciated by considering that if a battery life of time B is required, and the regulated output voltage can be maintained with a difference $\Delta V$ of almost zero from the battery voltage, a smaller battery may be used. The weight saved with a smaller battery is an important consideration in any battery operated equipment and may be critical in aircraft and space vehicles.

SUMMARY OF THE INVENTION

In accordance with the present invention, a circuit for regulating the output voltage delivered from a DC source is comprised of a bipolar transistor having its emitter electrode connected to the source and its collector electrode connected to a voltage output terminal, and a field-effect transistor connected to the base electrode of the bipolar transistor and connected to both the collector electrode of the bipolar transistor by a zener diode and to circuit ground by a small resistor. The gate electrode of the field effect transistor is connected to circuit ground by a large resistor. If the source voltage decreases, the output voltage tends to decrease, but the field-effect transistor then tends to increase its conductivity proportionately, thereby increasing the base current of the bipolar transistor to increase its conductivity and increase the output voltage proportionately. Regulation will be maintained until the source voltage decreases to a level which approaches the desired regulated output voltage to a very small differential. The extent to which that differential may be reduced is essentially limited by only the voltage drop in the regulating circuit between the voltage source and the output terminal.

The novel features that are considered characteristic of this invention are set forth with particularity in the appended claims. The invention will best be understood from the following description when read in connection with the accompanying drawings.

DESCRIPTION OF PREFERRED EMBODIMENT

Figure 1:
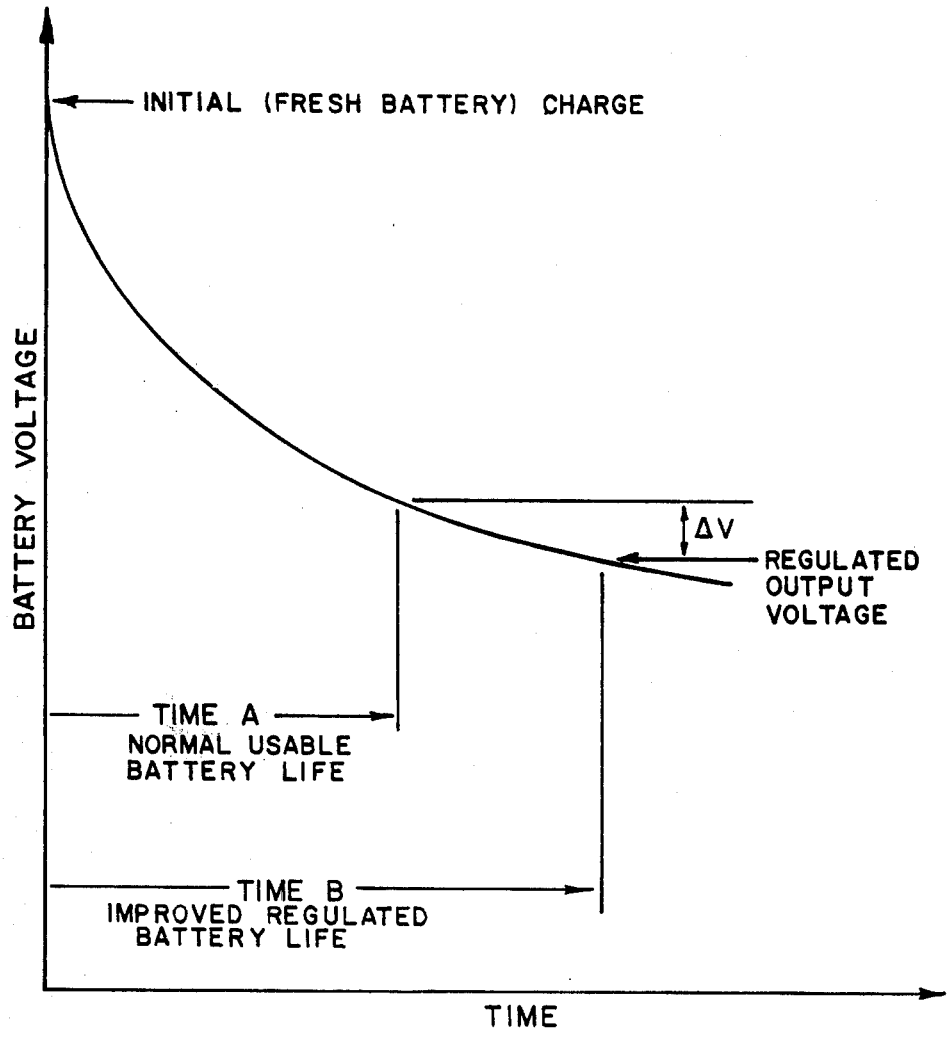
FIG. 1 is a graph useful in understanding the objectives and advantages of the present invention.
Figure 2:
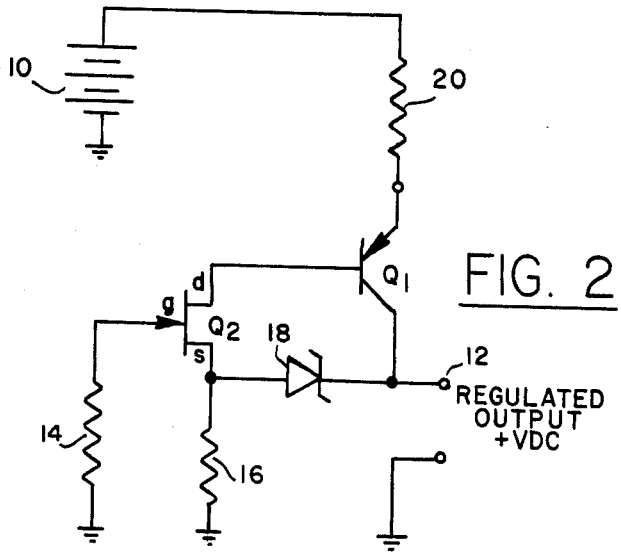
FIG. 2 is a circuit diagram of the present invention.

Referring now to FIG. 2 of the drawings, an improved battery voltage regulator is comprised of a bipolar transistor $Q_1$, having its emitter connected to a battery 10 and its collector connected to an output terminal 12 for delivering a regulated output voltage, and a field-effect transistor (FET) connecting the base of the bipolar transistor to the junction between the zener diode 18 and the bias resistor 16. A resistor 20 shown in series with the battery and the collector of the bipolar transistor represents the internal resistance of the battery and any external resistance that may be added, as will be described hereinafter.

The voltage drop between the emitter and collector of the bipolar transistor is regulated by its base current, which is in turn controlled by the FET. This control is established through the use of the zener diode 18 and the bias resistors 14 and 16. Assuming the regulated output voltage +VDC is to be 12 volts, the FET is biased by resistors 14 and 16 to control the base current for the bipolar transistor such that the voltage drop across it will reduce the initial battery voltage, such as +22 V or +15 V, to the desired regulated +12 V. The zener diode 18 and small resistor 16 (typically a ¼ watt resistor of 390 ohms for an 11-volts zener diode) establish the bias voltage for the FET which has its gate connected to circuit ground by the large resistor 14 (typically a ¼ watt resistor of 10 K ohms) to provide the regulated +12 VDC.

If the regulated output becomes less than 12 volts, as the battery voltage decays from its initial value, the regulated output voltage becomes less and will decrease the gate-source voltage of the FET and increase its drain current. Note that gate voltage of $Q_2$ is essentially ground and source voltage is regulated output voltage minus the zener voltage. That in turn increases the base current of the bipolar transistor causing it to conduct more, thereby causing the voltage drop across the emitter and collector to decrease. That will return the output voltage to 12 VDC. In that manner the FET is used to control the base current of the bipolar transistor to maintain the output voltage constant as the emitter voltage decreases from some voltage significantly greater than the regulated output voltage. The output voltage can be maintained until the voltage source approaches very nearly the level of the output voltage that is to be maintained.

Figure 3:
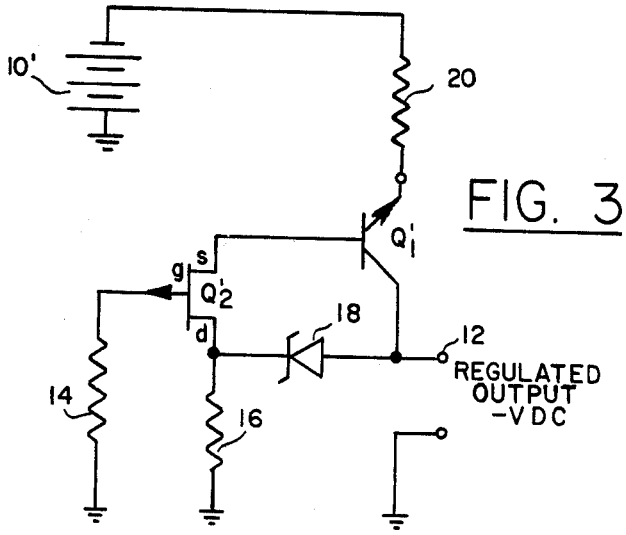
FIG. 3 is a circuit diagram of a modification of the present invention.

In the exemplary embodiment of FIG. 2 the voltage output is positive. Consequently the bipolar transistor is a PNP type and the field-effect transistor is an N type to achieve an increase of output voltage when it is too low, and a decrease in output voltage when it is too high. Use of a P-type field-effect transistor would accomplish the reverse, and would thus be self defeating. However, if the output voltage is to be negative, the bipolar transistor would be chosen to be of the NPN type and the field-affect transistor of the P type as shown FIG. 3 where transistors $Q_1$ and $Q_2$ are shown to be of the opposite conductivity type, and the zener diode 18 is reversed in polarity. In either case, the field effect transistor may be of the depletion mode or dual mode MOS type, or a junction type. The bipolar transistor may be a silicon transistor or a germanium transistor. The minimum difference between the output voltage and the source voltage is limited by the saturation resistance of the bipolar transistor in the circuit. Therefore the choice of bipolar transistor to be made is one having a very low saturation resistance. Some silicon transistors have a saturation resistance of 55 milliohms or less.

Another modification to the present invention is the inclusion of an external resistance between the battery source and the emitter of the bipolar transistor. Such a resistor is useful only when the initial battery voltage is much greater than that which the regulator has been designed to accommodate. Since such a resistor will have a substantial voltage drop, the extent to which the battery voltage may decrease while the circuit maintains the output voltage constant is decreased. Consequently, it is preferred that no external resistor be used, and that the resistor 20 be limited to the internal resistance of the battery. The entire regulator circuit consists of two transistors, two resistors and a zener diode.

Although particular embodiments of the invention have been described and illustrated herein, it is recognized that modifications and variations may readily occur to those skilled in the art. It is therefore intended that the claims be interpreted to cover such modifications and variations.

I claim:

1. A circuit for regulating the output voltage delivered from a source with respect to a source of ground reference potential, said circuit comprising: a bipolar transistor having a collector electrode, an emitter electrode, and a base electrode, said collector electrode being connected to a voltage output terminal and said emitter electrode being connected to said voltage source; a zener diode; a first resistor; a second resistor; a field-effect transistor having a source electrode, a drain electrode and a gate electrode, said gate electrode being connected to said source of ground reference potential by said first resistor, one of said source and drain electrode being connected to said base electrode of said bipolar transistor, and the other of said source and drain electrodes being connected to both said source of reference potential by said second resistor and to said collector electrode of said bipolar transistor by said zener diode with a polarity to cause said diode to be reverse-biased in the circuit.

2. A circuit as defined in claim 1 wherein said output voltage is positive and said bipolar transistor is a PNP type and said field-effect transistor is an N type.

3. A circuit as defined in claim 2 where said source is a battery having its negative terminal connected to said source of ground reference potential, and its positive terminal connected to said emitter electrode of said bipolar transistor.

4. A circuit as defined in claim 3 including a resistor in series between said positive terminal and said emitter electrode.

5. A circuit as defined in claim 1 wherein said output voltage is negative and said bipolar transistor is an NPN type and said field-effect transistor is a P type.

6. A circuit as defined in claim 5 wherein said source is a battery having its positive terminal connected to said source of ground reference potential, and its negative terminal connected to said emitter electrode of said bipolar transistor.

7. A circuit as defined in claim 6 including a resistor in series between said negative terminal and said emitter electrode.

* * * * *